US008760314B2

(12) United States Patent
Ramachandran

(10) Patent No.: US 8,760,314 B2
(45) Date of Patent: Jun. 24, 2014

(54) CO-OPERATIVE TRAFFIC NOTIFICATION

(75) Inventor: Prashanth Ramachandran, Foster City, CA (US)

(73) Assignee: Apple Inc., Cupertino, CA (US)

( * ) Notice: Subject to any disclaimer, the term of this patent is extended or adjusted under 35 U.S.C. 154(b) by 72 days.

(21) Appl. No.: 13/493,426

(22) Filed: Jun. 11, 2012

(65) Prior Publication Data

US 2013/0328698 A1 Dec. 12, 2013

(51) Int. Cl.
*G08G 1/09* (2006.01)

(52) U.S. Cl.
USPC ..... 340/905; 340/995.13; 701/414

(58) Field of Classification Search
USPC ..... 340/995.13, 905; 701/414
See application file for complete search history.

(56) References Cited

U.S. PATENT DOCUMENTS

| | | | | |
|---|---|---|---|---|
| 2007/0088488 | A1* | 4/2007 | Reeves et al. | 701/117 |
| 2007/0273559 | A1* | 11/2007 | Furuya et al. | 340/995.13 |
| 2010/0045452 | A1* | 2/2010 | Periwal | 340/439 |
| 2012/0083995 | A1* | 4/2012 | Vorona | 701/119 |
| 2012/0123667 | A1* | 5/2012 | Gueziec | 701/119 |
| 2012/0296559 | A1* | 11/2012 | Gueziec et al. | 701/117 |
| 2013/0211700 | A1* | 8/2013 | Igodt | 701/117 |

OTHER PUBLICATIONS

Author Unknown, "Never Be Late Again!" Inrix Traffic, retrieved on Oct. 18, 2012, 2 pages. Retrieved from: http://www.inrixtraffic.com/ [Oct. 18, 2012 3:49:25 PM].

Author Unknown, "New !IPhone App TrafficTweet Leverages Twitter for Real-Time Stream Driving Conditions," Gadgets paint—Widget in Life, retrieved on Oct. 18, 2012, 3 pages. Retrieved from: http://digital.widgetinlife.com/New-iPhone-App-TrafficTweet-Leverages-Twitter-for-Real-Time-Stream-Driving-Conditions/.

Foreman, K. "Magic? How Inrix Traffic Crowd-Sourcing Really Works," Inrix Traffic Blog, retrieved on Oct. 18, 2012, 3 pages. Retrieved from: http://www.inrixtrafficblog.com/?p=132.

Furchgott, R. "Google Adds to the Traffic-App Pileup," NYTimes.com, retrieved on Oct. 18, 2012, 4 pages. Retrieved from: http://gadgetwise.blogs.nytimes.com/2009/08/27/google-adds-to-the-traffic-app-pileup/.

Lynch, B. "Google App Now Helps You Steer Clear of Traffic Jams," PCWorld, retrieved on Oct. 18, 2012, 6 pages. Retrieved on: http://www.pcworld.com/article/221642/google_gps_traffic.html.

* cited by examiner

*Primary Examiner* — Brent Swarthout
(74) *Attorney, Agent, or Firm* — Kilpatrick Townsend & Stockton LLP

(57) ABSTRACT

Upon detecting a request for traffic information or abnormal motion, a mobile electronic device can generate and transmit a first signal to a remote traffic-information generator, the first signal identifying a location and motion of the device. The remote traffic-information generator can aggregate this type of data across devices and estimate traffic information, assuming that traffic is normal along roads not associated with first signals. The remote traffic-information generator can transmit a second signal with estimated traffic information back to the device. The conditioned transmission can allow real-time traffic information to be efficiently estimated while conserving devices' power usage and the remote traffic-information generator's processing and storage resources.

21 Claims, 7 Drawing Sheets

CO-OPERATIVE TRAFFIC NOTIFICATION

BACKGROUND

The present disclosure relates generally to receiving motion-identifying signals from a plurality of mobile electronic devices and determining current traffic information based on the motion.

Traffic patterns can exhibit a large degree of unpredictability. For example, vehicle accidents, new construction efforts, weather-based road damage, and road closures can cause direct traffic congestion (e.g., on an affected road) and indirect traffic congestion (e.g., on another road or on a same road with respect to traffic moving in an opposite direction).

At times, a person's traveling patterns can be flexible. For example, the person can commute to a destination along an alternative route, or a person can adjust a departure time. In order to identify whether one such strategy should be implemented, it is useful to identify a status of traffic along potential routes. A person can, e.g., watch a television traffic report prior to his morning commute and determine an initial route. However, the television traffic report may not provide adequate detail with regard to a particular route, or events can soon modify traffic conditions. Once in route, it can be difficult to determine whether to adjust a commute to avoid traffic. A driver can be trapped in deadlock traffic prior to realizing an extent of congestion, or a driver may have missed an exit to his alternative route before realizing a degree of upcoming congestion.

Encounters of high-traffic conditions are likely to frustrate a driver and to reduce the time that the driver can otherwise spend on productive or leisure activities. Additionally, accumulating more vehicles within a congested area can have environmental consequences: vehicles running for longer periods of time and subjected to larger variations in speed can result in increased pollution.

SUMMARY

Certain embodiments of the present invention provide cooperative traffic notification services to a set of mobile devices that both provide and receive information about traffic conditions in response to user requests. For example, a signal including location and motion information can be conditionally received, by a remote traffic-information generator, from each device of a subset of a set of devices (e.g., mobile phones). For example, a condition can indicate that the motion information is to be transmitted from a device if the device is requesting or recently requested traffic information. As another example, a condition can indicate that the motion information is to be transmitted from a device if abnormal motions are detected (e.g., slowdowns or repeated braking). The condition can be implemented at the devices (e.g., a condition preceding a device's push of information) and/or at the remote traffic-information generator (e.g., a condition preceding the server's pull of information).

Based on the location and motion information, current traffic information can be updated. Traffic information can include traffic parameters such as average vehicle speeds along one or more roads (e.g., interstates, highways, streets, unpaved roads, etc.); areas or road portions of congestions; degrees or lengths of congestions; and/or locations of sources of congestions. In some instances, personalized traffic information can be identified based on the location and/or motion information and on general traffic information. For example, personalized traffic information can include traffic parameters associated with a road on which the location is located.

As another example, personalized traffic information can include traffic parameters associated with an upcoming road on a route or a road identified by a user of the device. In some instances, personalized traffic information can relate to a congestion along a road or route that the device is on. A second signal including traffic information (e.g., general or personalized traffic information) can be transmitted to a device that requested the traffic information, a device that transmitted location and/or motion information, a device near a congestion, or another device.

Receiving motion data from devices in a conditional manner can conserve resources while still allowing identification of pertinent traffic information. For example, if few signals are being received from devices on major road, it can be assumed that traffic experiences along the road are average or good (e.g., if the major road is associated with adequate cellular coverage). In embodiments in which signals are transmitted from a device upon receipt of a user request for traffic information, drivers can be disinterested in traffic information due to reasonable traffic speeds. In embodiments in which signals are transmitted upon detection of abnormal motion, relatively few signals can be transmitted due to maintained levels of a reasonable speeds. Such conditional signal transmission can, e.g., preserve power usage (e.g., battery usage) of transmitting devices, reduce processing and storage requirements of receiving devices, and improve traffic-information estimation times.

These and other embodiments of the invention along with many of its advantages and features are described in more detail in conjunction with the text below and attached figures.

DETAILED DESCRIPTION

Figure 1A:
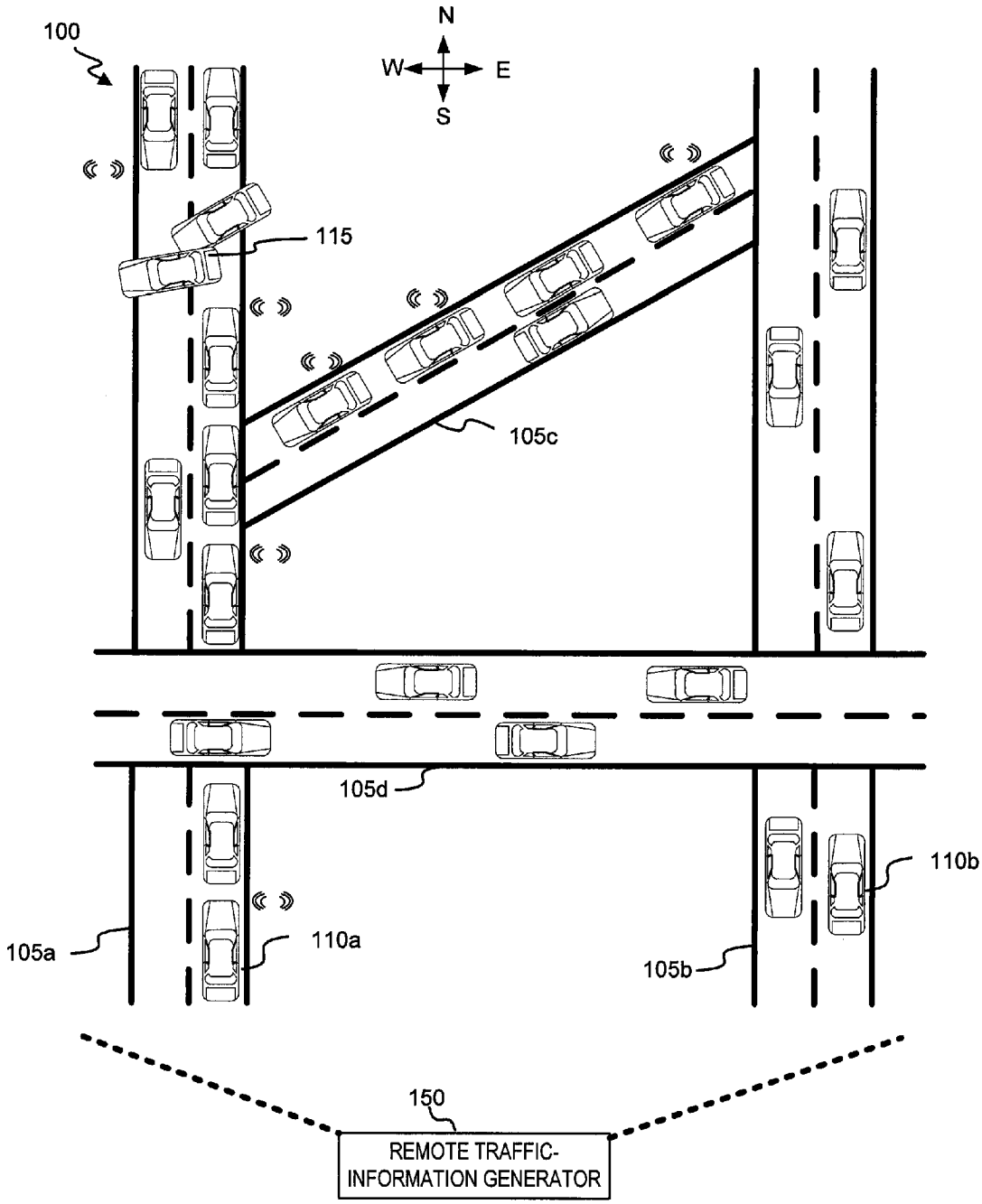
FIGS. 1A-1C illustrate a system for estimating traffic information.

According to various embodiments of the present invention, a signal including location and motion information can be conditionally received, by a remote traffic-information generator, from each device of a subset of a set of devices (e.g., mobile phones). For example, a condition can indicate that the motion information is to be transmitted from a device if the device is requesting or recently requested traffic information. As another example, a condition can indicate that the motion information is to be transmitted from a device if abnormal motions are detected (e.g., slowdowns or repeated breaking). The condition can be implemented at the devices (e.g., a condition preceding a device's push of information) and/or at the remote traffic-information generator (e.g., a condition preceding the server's pull of information).

Based on the location and motion information, current traffic information can be updated. Traffic information can include traffic parameters such as average vehicle speeds along one or more roads (e.g., interstates, highways, streets, unpaved roads, etc.); areas or road portions of congestions; degrees or lengths of congestions; and/or locations of sources of congestions. In some instances, personalized traffic information can be identified based on the location and/or motion information and on general traffic information. For example, personalized traffic information can include traffic parameters associated with a road on which the location is located. As another example, personalized traffic information can include traffic parameters associated with an upcoming road on a route or a road identified by a user of the device. In some instances, personalized traffic information can relate to a congestion along a road or route that the device is on. A second signal including traffic information (e.g., general or personalized traffic information) can be transmitted to a device that requested the conditions, a device that transmitted location and/or motion information, a device near a congestion, or another device.

Receiving motion data from devices in a conditional manner can conserve resources while still allowing identification of pertinent traffic information. For example, if few signals are being received from devices on major road, it can be assumed that traffic experiences along the road are average or good (e.g., if the major road is associated with adequate cellular coverage). In embodiments in which signals are transmitted from a device upon receipt of a user request for traffic information, drivers can be disinterested in traffic information due to reasonable traffic speeds. In embodiments in which signals are transmitted upon detection of abnormal motion, relatively few signals can be transmitted due to maintained levels of a reasonable speeds. Such conditional signal transmission can, e.g., preserve power usage (e.g., battery usage) of transmitting devices, reduce processing and storage requirements of receiving devices, and improve traffic-information estimation times.

Figure 1B:
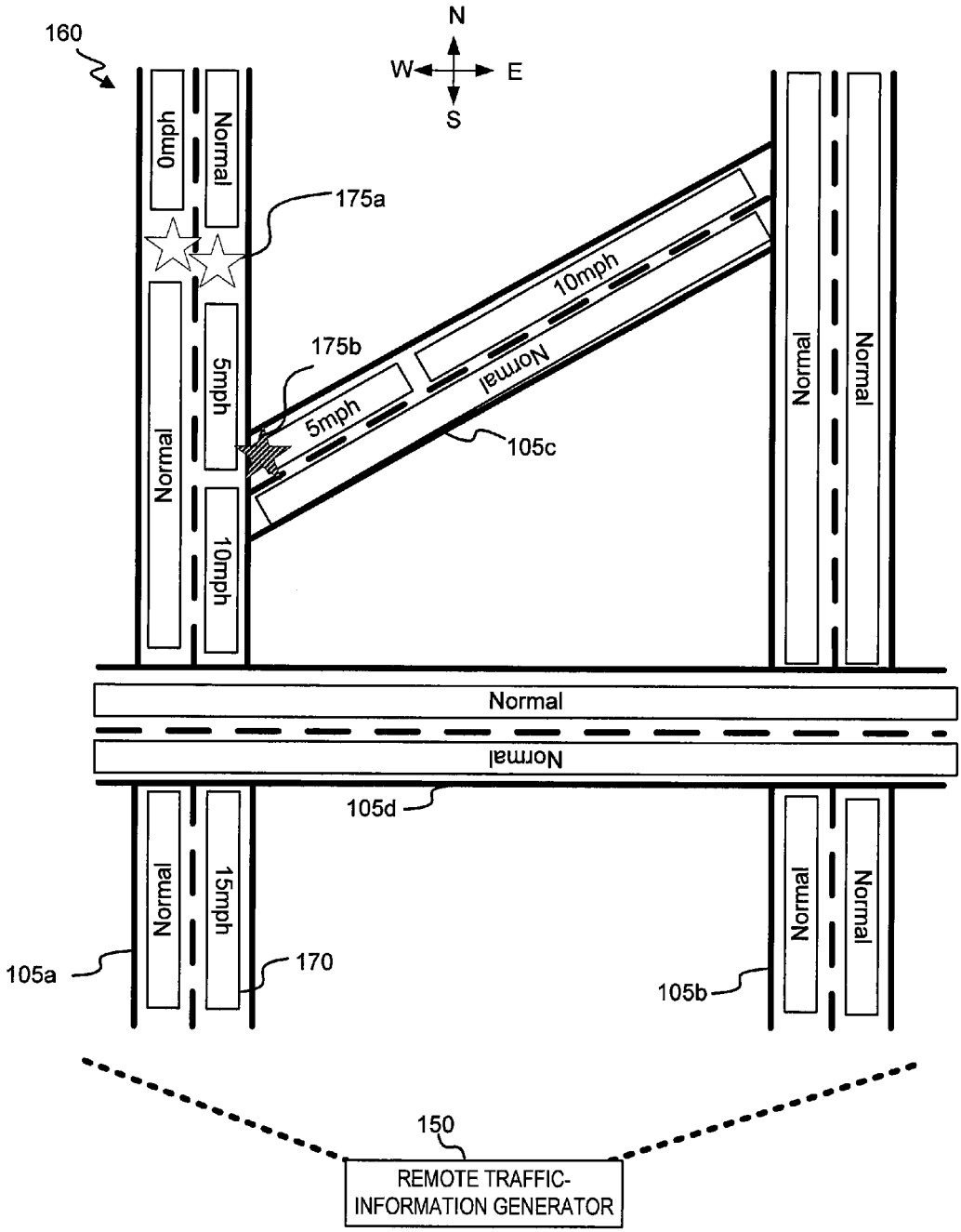
Figure 1C:
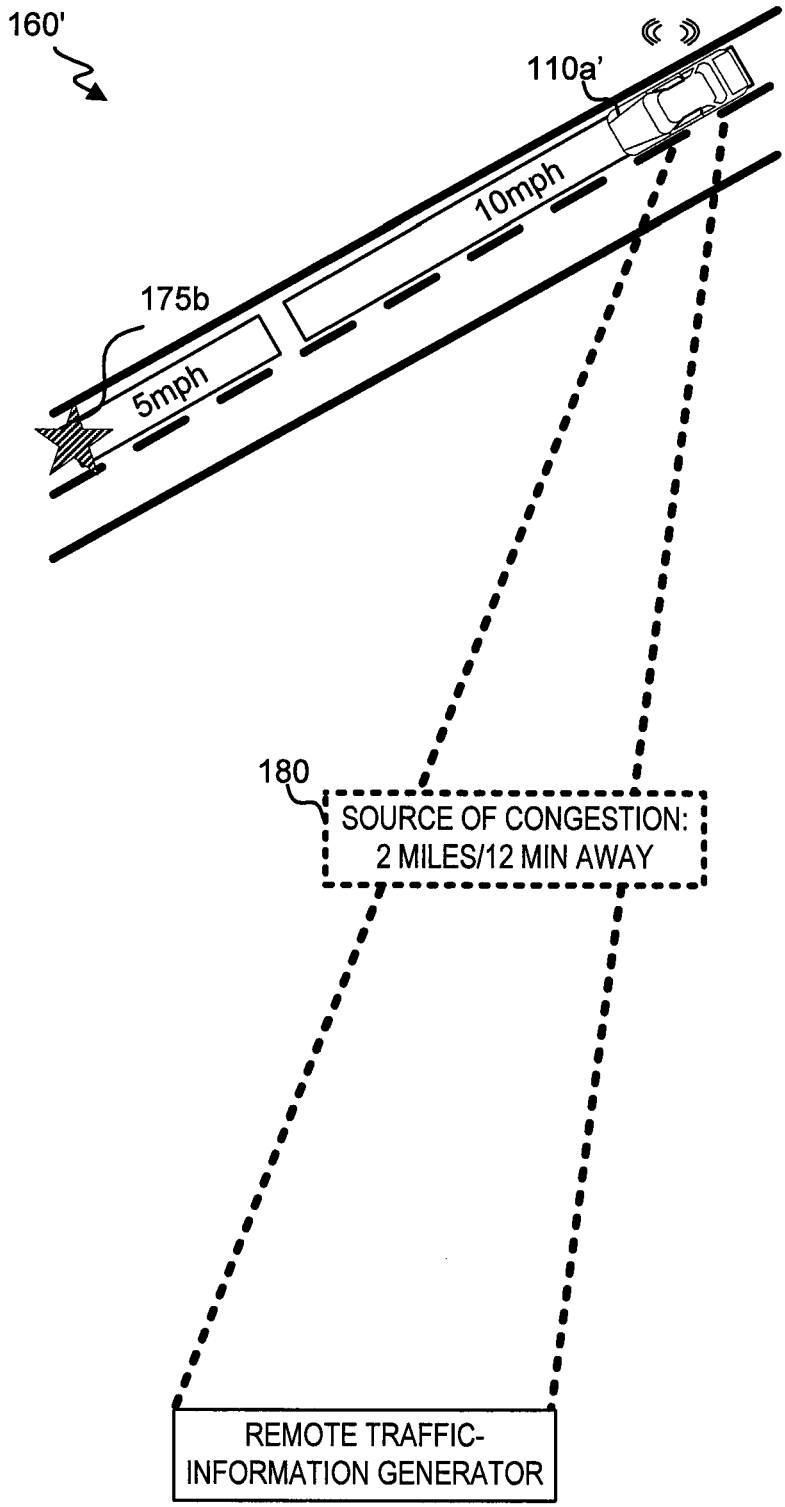

FIGS. 1A-1C illustrate a system 100 for estimating traffic information. In this example, a pictorial illustration of vehicle locations on a network of highways or roads is illustrated. The illustration is not to scale and can underrepresent lanes. In the illustration of FIG. 1A, four highways 105*a*-105*d* are represented. Highways 105*a* and 105*b* run north to south. Highway 105*c* runs between highways 105*a* and 105*b*, and highway 105*a* and 105*c* intersect such that traffic can merge across the highways. Highway 105*d* includes a bridge that crosses over highways 105*a* and 105*b*.

In the illustration of FIG. 1A, vehicles 110 are traveling on the depicted highways 105. An accident 115 has occurred on highway 105*a*, causing congestion in both lanes of 105*a* preceding accident 115 and along the west-bound lane of highway 105*c*. Highways 105*b* and 105*d* are relatively unaffected by accident 115, as are the east-bound lane of highway 105*c* and the lanes of highway 105*a* after accident 115.

Vehicles 110 can include transmitting vehicles 110*a* and non-transmitting vehicles 110*b*. Transmitting vehicles 110*a* can include vehicles that generate and transmit a signal to a remote traffic-information generator 150. In some embodiments, transmission of the signal is initiated by user input indicating, a request for personalized traffic information (e.g., regarding congestion on a particular road) or a request for general traffic information. Traffic information can include values of one or more traffic parameters, and, in some instances, user input can identify traffic parameters of interest.

In some embodiments, transmission of the signal is initiated by a result of an automatic process and can include, e.g., detection of an abnormal motion (e.g., relatively slow speed, frequent acceleration, or large deceleration). Signals can be transmitted by transmitting vehicles 110*a* themselves, an accessory integrated into the vehicles, or an independent accessory (e.g., a mobile phone) located in the vehicles. Non-transmitting vehicles 110*b* can include vehicles not associated with a similar or same type of signal transmission.

In some embodiments, a mobile electronic device in transmitting vehicles 110*a* is executing a program or application that causes, e.g., generation and transmission of the signal. The program or application can initiate the signal transmission in response to, e.g., user input or an automatic-process result. In some instances, a mobile electronic device can also be present in one or more non-transmitting vehicles 110*b*, and the mobile electronic device can be executing the same program or application. However, non-transmitting vehicles 110*b* may, in some instances, not transmit similar or same types of signals due to a lack of similar user input or automatic-process results.

In FIG. 1A, transmitting vehicles 110*a* can include a mobile electronic device executing an application, and users can initiate signal transmissions by requesting traffic information. Non-transmitting vehicles 110*b* can include vehicles that do not have mobile electronic devices executing the application in the vehicle and/or vehicles that have mobile electronic devices executing the application that did not receive similar user requests for traffic information. In FIG. 1A, transmitting vehicles 110*a* are concentrated within areas of congestion (having a relatively high vehicle density). For example, a large proportion of vehicles 110 on the northbound lane of highway 105*a* are transmitting vehicles 110*a*, while no vehicles on highway 105*b* or highway 105*d* are transmitting vehicles 110*a*. This can be due to the higher density of vehicles in congested areas and drivers being more likely to request traffic information when experiencing traffic congestion. Thus, in some instances, it can be assumed that there is little to no congestion along roads or road portions not associated with a relatively high frequency of transmitted signals. This assumption can be made, e.g., if it is determined that the roads or road portions are not associated with poor cellular coverage (e.g., due to previous receipt of signals from the road or road portions or signal-strength measurements).

Each transmitting vehicle 110*a* can send a signal to remote traffic-information generator 150 that identifies location information (e.g., geographic coordinates) and motion information (e.g., an acceleration, velocity or speed) associated with the vehicle 110*a*. For example, a mobile phone in transmitting vehicles 110*a* can determine its own velocity based on a motion detector (e.g., the motion being largely attributable to a vehicle speed), and the signal can include the determined velocity. In some instances, an initial signal transmitted from vehicle 110*a* does not include the motion information (e.g., and instead can request traffic information) and a subsequent signal (e.g., responding to a request for motion information) can include the motion information. For example, remote traffic-information generator 150 can request or pull a subsequent signal from a particular device upon receipt of an initial signal. In some instances, a single signal received by remote traffic-information generator 150 can include a request for traffic information and also provide motion information.

Remote traffic-information generator 150 can receive signals transmitted from transmitting vehicles 110*a*, aggregate data in the signals, and/or estimate traffic information based on the aggregated data. Remote traffic-information generator 150 can estimate parameter values associated with specific roads or specific portions of a road. The parameters can include, e.g., an average traffic speed, a median traffic speed direction of traffic, or a traffic-speed distribution. Remote traffic-information generator 150 can estimate locations of traffic congestion (e.g., estimating specific portions of roads with congestion), magnitudes of traffic congestion (e.g., average actual speeds with respect to normal speeds or speed limits), and/or locations of sources or "heads" of traffic congestion (e.g., a location along the road at which traffic conditions change from congested to non-congested). Remote traffic-information generator 150 can estimate time-sensitive characteristics (e.g., a duration of congestion, change across time in congestion or prediction of future congestion).

In some instances, remote traffic-information generator 150 estimates parameters at least in part from external sources not tied to mobile devices in vehicles. For example, remote traffic-information generator 150 can use aerial photography photographs, public traffic alerts, and/or online traffic data to contribute to estimates of parameter values.

Results of the estimations performed by remote traffic-information generator 150 can include a variety of formats. For example, pre-defined or dynamically defined road portions can be associated with a value of a parameter (e.g., average traffic speed). Road portions can be dynamically defined based on the estimates themselves or received data (e.g., such that the different road portions are generally associated with different parameter values). For example, road portions can be defined to keep parameter-value variability within a portion below a threshold or to constrain a number of samples contributing to a portion.

As another example, functions or equations can be defined to represent parameter values. For example, gradual traffic-speed decreases along a road can be represented by an exponential, linear function, and/or power function. Coefficient values of the function or equation can be defined based on the received data.

As yet another example, traffic information can include a traffic map that represents the estimates of traffic-parameter values. FIG. 1B shows an example of a traffic map 160 generated based on the data in signals transmitted from transmitting vehicles 110*a* in FIG. 1A. Traffic map 160, as depicted in FIG. 1B, identifies a network of roads (e.g., highways 105*a*-105*d*) and values of traffic parameters for portions 170 of the roads. The extent of a portion of a road can depend on value variation along the road. For example, highway 105*d* has a single portion 170 for each lane across the highway, whereas the north-bound land of highway 105*a* includes four portions 170 within the depicted area. This can be because the accident 115 caused greater variation in traffic speeds than occur along highway 105*d*.

Some of the depicted traffic portions 170 are shown to correspond to a quantitative traffic-parameter value, such as value of an average traffic speed. Other of the depicted traffic portions 170 are shown to correspond to qualitative characteristics of the variable values, such as "Normal" speeds. Qualitative characteristics can be based, e.g., on speed limits, empirical average speed distributions, time-matched empirical average speed distributions, and/or differences between average speed distributions and a speed limit. Thus, in some embodiments, "Normal" can represent that the traffic along highway 105*d* is traveling at an average estimated speed of 55 mph even if the speed limit on highway 105*d* is 70 mph. Traffic map 160 can alternatively or additionally include other types of traffic parameters (e.g., velocities, speed or velocity distributions, integrated absolute accelerations, or median speeds or velocities).

Traffic map 160 can include one or more congestion-source identifiers 175. Congestion-source identifiers 175 can identify a location associated with a source of congestion. The source can be estimated, e.g., by analyzing location-based trends in a motion variable or traffic parameter. For example, on the north-bound lane of highway 105*a*, speeds gradually slow down until location 175*a* then return to normal after location 175*a*. Thus, locations of congestion sources can be estimated, e.g., by identifying a discontinuity or inversion point with respect to a location-based trend of a motion variable or traffic parameter.

Congestion-source identifiers 175 can include primary congestion-source identifiers 175*a* and/or secondary congestion-source identifiers 175*b*. Primary congestion-source identifiers 175*a* can represent global (i.e., across a road network) sources of congestion. Primary congestion-source identifiers 175*a* can be identified by, e.g., applying algorithms or mathematical techniques and can (in some instances) be associated with real-world circumstances such as accidents (e.g., accident 115), construction, road mergers, or traffic lights. Secondary congestion-source identifiers 175*a* can represent non-global sources of congestion. For example, the congestion on the west-bound lane of highway 105*c* can be due to accident 115 on highway 105*a* (represented by congestion-source identifier 175*a*). However, with respect to highway 105*c*, the source of the congestion is the exit leading to highway 105*a*. Thus, a secondary congestion-source identifier 175*b* can be identified to represent a local source of congestion.

In some instances, traffic congestion is "sourceless", such that there is no specific cause resulting in the congestion. For example, the congestion may be caused by high vehicle density generally, but not by any particular accident or construction site. Nevertheless, the congestion may still be associated with a "head", the head being a location at which speeds (e.g., absolute speeds, filtered speeds or ratios of actual speeds relative to speed limits) reach a local minimum. It will thus be understood that disclosures herein that refer to a congestion "source" may be similarly to applied to a congestion "head" in instances in which congestion is sourceless.

Based on the estimations performed by remote traffic-information generator 150 (e.g., based on traffic map 160), remote traffic-information generator 150 can further estimate more detailed and/or personalized traffic information. FIG. 1C illustrates an example of personalized traffic information 180 that can be included in a second signal transmitted to a particular transmitting vehicle 110*a*' (e.g., to an accessory integrated in vehicle 110*a*' or to a mobile electronic device in vehicle 110*a*'). Personalized traffic information can include traffic parameters characterizing traffic along a road or route currently being traveled by a transmitting vehicle. In some instances, personalized traffic information indicates an existence and/or location of an estimated congestion source 175 along a road or route being traveled by a transmitting vehicle 110*a* and/or can include an estimated time or distance between transmitting vehicle 110*a* and congestion source 175. For example, in this instance, personalized traffic information 180 include an estimate that vehicle 110*a*' is two miles and twelve minutes away from secondary congestion source 175*b*. Personalized traffic information 180 can further include traffic map 160 or a traffic-map portion 160' that is potentially relevant to transmitting vehicle 110*a*' (e.g., that includes a road or route currently being travelled by transmitting vehicle 110*a*').

It will be appreciated that the illustrations in FIGS. 1A-1C are illustrative and that variations and modifications are possible. For example, in some instances, primary and second congestion sources 175*a* and 175*b* are not be distinguished, or only primary congestion sources 175*a* are identified. As further examples, estimated traffic information need not include discrete traffic portions 170 (e.g., and can instead include point information or continuum information).

Figure 2:
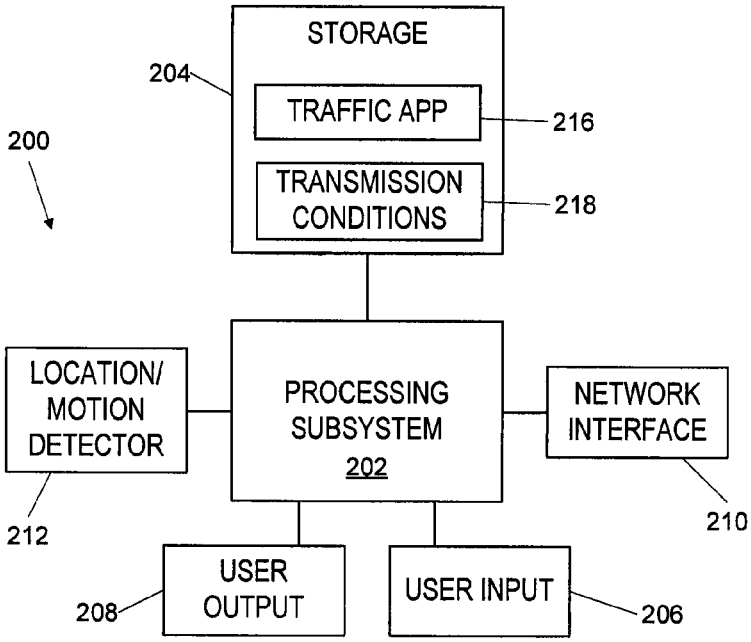
FIG. 2 is a simplified block diagram of an implementation of a device within transmitting vehicles according to an embodiment of the present invention.

FIG. 2 is a simplified block diagram of an implementation of a device 200 within a transmitting vehicle 110*a* according to an embodiment of the present invention. Device 200 can be integrated with or attached to transmitting vehicle 110*a*. In some instances, device 200 can be physically separate from transmitting vehicle 110*a* and can be positioned within transmitting vehicle 110*a*. Device 200 can be a mobile electronic device, such as a cellular phone, a smartphone, or any device that a user is likely to carry on his/her person and that is capable of communicating with a remote traffic-information generator 150 as described herein. Device 200 includes a processing subsystem 202, a storage subsystem 204, a user input device 206, a user output device 208, a network interface 210, and a location/motion detector 212.

Processing subsystem 202, which can be implemented as one or more integrated circuits (e.g., e.g., one or more single-core or multi-core microprocessors or microcontrollers), can control the operation of device 200. In various embodiments, processing subsystem 202 can execute a variety of programs in response to program code and can maintain multiple concurrently executing programs or processes. At any given time, some or all of the program code to be executed can be resident in processing subsystem 202 and/or in storage subsystem 204.

Through suitable programming, processing subsystem 202 can provide various functionality for device 200. For example, processing subsystem 202 can execute a traffic application program (or "app") 216. Traffic app 216 can provide various functionality such as detecting a location of device 200 (e.g., based on data received from location/motion detector 212), detecting traffic information characterizing traffic near device 200, and/or detecting traffic information characterizing traffic along a road or route that device 200 is on. Traffic app 216 can further provide, e.g., directions to a destination location and/or an estimate of a time at which device 200 will reach the destination location.

In some instances, traffic app 216 can detect whether a transmission condition 218 has been satisfied. For example, traffic app 216 can determine whether a request from user input 206 for traffic information has been received or whether abnormal motion of device 200 has been detected. Traffic app 216 can then cause generation of a signal that, e.g., requests traffic information, identifies a current location and/or identifies a current motion (e.g., a velocity or average velocity). Traffic app 216 can then initiate transmission of the signal (e.g., via network interface 210) to remote traffic-information generator 150.

Storage subsystem 204 can be implemented, e.g., using disk, flash memory, or any other storage media in any combination, and can include volatile and/or non-volatile storage as desired. In some embodiments, storage subsystem 204 can store one or more application programs to be executed by processing subsystem 202 (e.g., traffic app 216). In some embodiments, storage subsystem 204 can store other data (e.g., used by and/or defined by traffic app 216), such as transmission conditions 218 that identify criteria that must be satisfied prior to transmitting signals (generally or signals of a specific type) to remote traffic-information generator 150. Programs and/or data can be stored in non-volatile storage and copied in whole or in part to volatile working memory during program execution.

A user interface can be provided by one or more user input devices 206 and one or more user output devices 208. User input devices 206 can include a touch pad, touch screen, scroll wheel, click wheel, dial, button, switch, keypad, microphone, or the like. User output devices 208 can include a video screen, indicator lights, speakers, headphone jacks, or the like, together with supporting electronics (e.g., digital-to-analog or analog-to-digital converters, signal processors, or the like). A user can operate input devices 206 to invoke the functionality of device 200 and can view and/or hear output from device 200 via output devices 208.

Network interface 210 can provide voice and/or data communication capability for device 200. For example, network interface 210 can provide device 200 with the capability of communicating with remote traffic-information generator 150. In some embodiments network interface 210 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), and/or other components. In some embodiments network interface 210 can provide wired network connectivity (e.g., Ethernet) in addition to or instead of a wireless interface. Network interface 210 can be implemented using a combination of hardware (e.g., antennas, modulators/demodulators, encoders/decoders, and other analog and/or digital signal processing circuits) and software components.

Location/motion detector 212 can detect a past, current or future location of device 200 and/or a past, current or future motion of device 200. For example, location/motion detector 212 can detect a velocity or acceleration of mobile electronic device 200. Location/motion detector 212 can comprise a Global Positioning Satellite (GPS) receiver and/or an accelerometer. In some instances, processing subsystem 202 determines a motion characteristic of device 200 (e.g., velocity) based on data collected by location/motion detector 212. For example, a velocity can be estimated by determining a distance between two detected locations and dividing the distance by a time difference between the detections.

Figure 3:
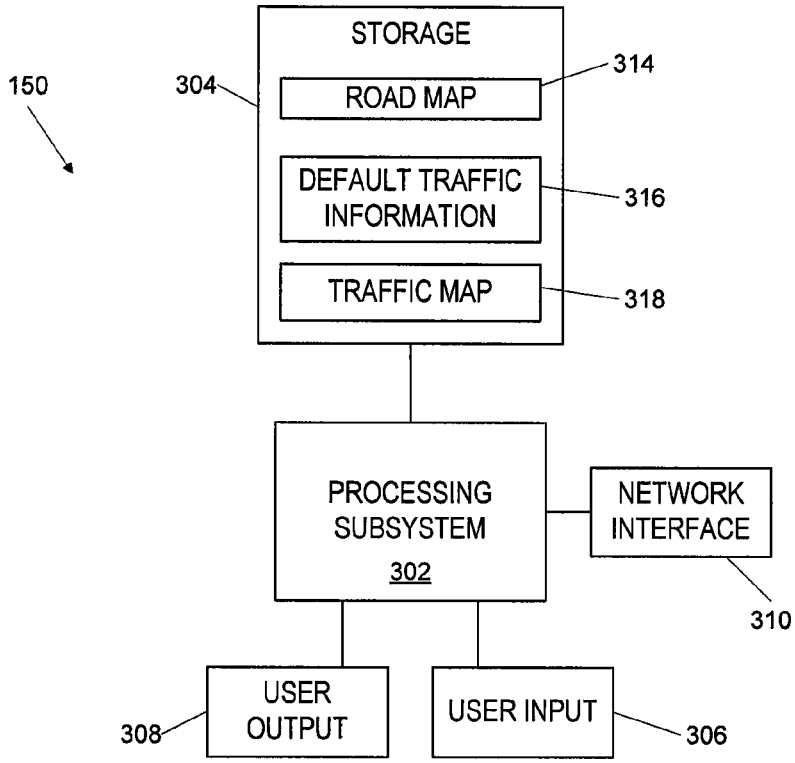
FIG. 3 is a simplified block diagram of an implementation of remote traffic-information generator according to an embodiment of the present invention.

FIG. 3 is a simplified block diagram of an implementation of remote traffic-information generator 150 according to an embodiment of the present invention. Remote traffic-information generator 150 includes a processing subsystem 302, storage subsystem 304, a user input device 306, a user output device 308, and a network interface 310. Network interface 310 can have similar or identical features as network interface 210 of device 200 described above.

Processing subsystem 302, which can be implemented as one or more integrated circuits (e.g., a conventional microprocessor or microcontroller), can control the operation of remote traffic-information generator 150. In various embodiments, processing subsystem 302 can execute a variety of programs in response to program code and can maintain multiple concurrently executing programs or processes. At any given time, some or all of the program code to be executed can be resident in processing subsystem 302 and/or in storage subsystem 304.

Through suitable programming, processing subsystem 302 can provide various functionality for remote traffic-information generator 150. Thus, remote traffic-information generator 150 can interact with a traffic app 216 being executed on a device 200 in order to provide a traffic-information service. For example, processing subsystem 302 can aggregate data in signals received from multiple devices. Processing subsystem 302 can identify a road or route corresponding to a location identified in a signal (e.g., by consulting location/ road map 314), such that the aggregation can be performed in a road-specific manner. Using the aggregated data, processing subsystem 302 can estimate traffic information that include traffic-parameter values associated with a set of roads (e.g., by filtering, interpolating and/or extrapolating point-source data). In some instances, the estimated traffic information can depend on default traffic information 316 (e.g., to identify an extent of congestion based on comparing a current motion with a typical motion). Processing subsystem 302 can further identify a location of a source of traffic congestion (e.g., by identifying an inversion or discontinuity point in traffic-parameter values along a road). The traffic information can be stored in a traffic map 318 (e.g., associating specific road portions with traffic information).

Using the estimated traffic information, personalized traffic information (specific to a location of a particular device 200) can be further estimated. The personalized traffic information can identify, e.g., a distance to a congestion source, a time to a congestion source or nearby traffic-parameter values. Thus, the personalized traffic information can depend on a location of a device 200 (e.g., identified in a received signal) and/or a road that device 200 is on (e.g., identified by associating the device location with a road). Processing subsystem 302 can cause a signal to be generated, the signal including general and/or personalized traffic information. Processing subsystem 302 can further initiate transmission of the signal (e.g., via network interface 310) to a device 200.

Storage subsystem 304 can be implemented, e.g., using disk, flash memory, or any other storage media in any combination, and can include volatile and/or non-volatile storage as desired. In some embodiments, storage subsystem 304 can store one or more application programs to be executed by processing subsystem 302. In some embodiments, storage subsystem 304 can store other data, such as road map 314 (that associates locations with roads), default traffic information 316, and/or traffic map 318. Programs and/or data can be stored in non-volatile storage and copied in whole or in part to volatile working memory during program execution.

A user interface can be provided by one or more user input devices 306 and one or more user output devices 308. User input and output devices 306 and 308 can be similar or identical to user input and output devices 206 and 208 of device 200 described above. In some instances, user input and output devices 306 and 308 are configured to allow a programmer to interact with remote traffic-information generator 150. In some instances, traffic-information generator 150 can be implemented at a server of set of farmers, and the user interface need not be local to the servers.

It will be appreciated that device 200 and remote traffic-information generator 150 described herein are illustrative and that variations and modifications are possible. A device can be implemented as a mobile electronic device and can have other capabilities not specifically described herein (e.g., telephonic capabilities, power management, accessory connectivity, etc.). In a system with multiple devices 200 and/or multiple remote traffic-information generators 150, different devices 200 and/or remote traffic-information generators 150 can have different sets of capabilities; the various devices 200 and/or remote traffic-information generators 150 can be but need not be similar or identical to each other.

Further, while device 200 and remote traffic-information generator 150 are described with reference to particular blocks, it is to be understood that these blocks are defined for convenience of description and are not intended to imply a particular physical arrangement of component parts. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Embodiments of the present invention can be realized in a variety of apparatus including electronic devices implemented using any combination of circuitry and software.

Additionally, while device 200 and remote traffic-information generator 150 are described as singular entities, it is to be understood that each can include multiple coupled entities. For example, remote traffic-information generator 150 can include, a server, a set of coupled servers, a computer and/or a set of coupled computers.

Figure 4:
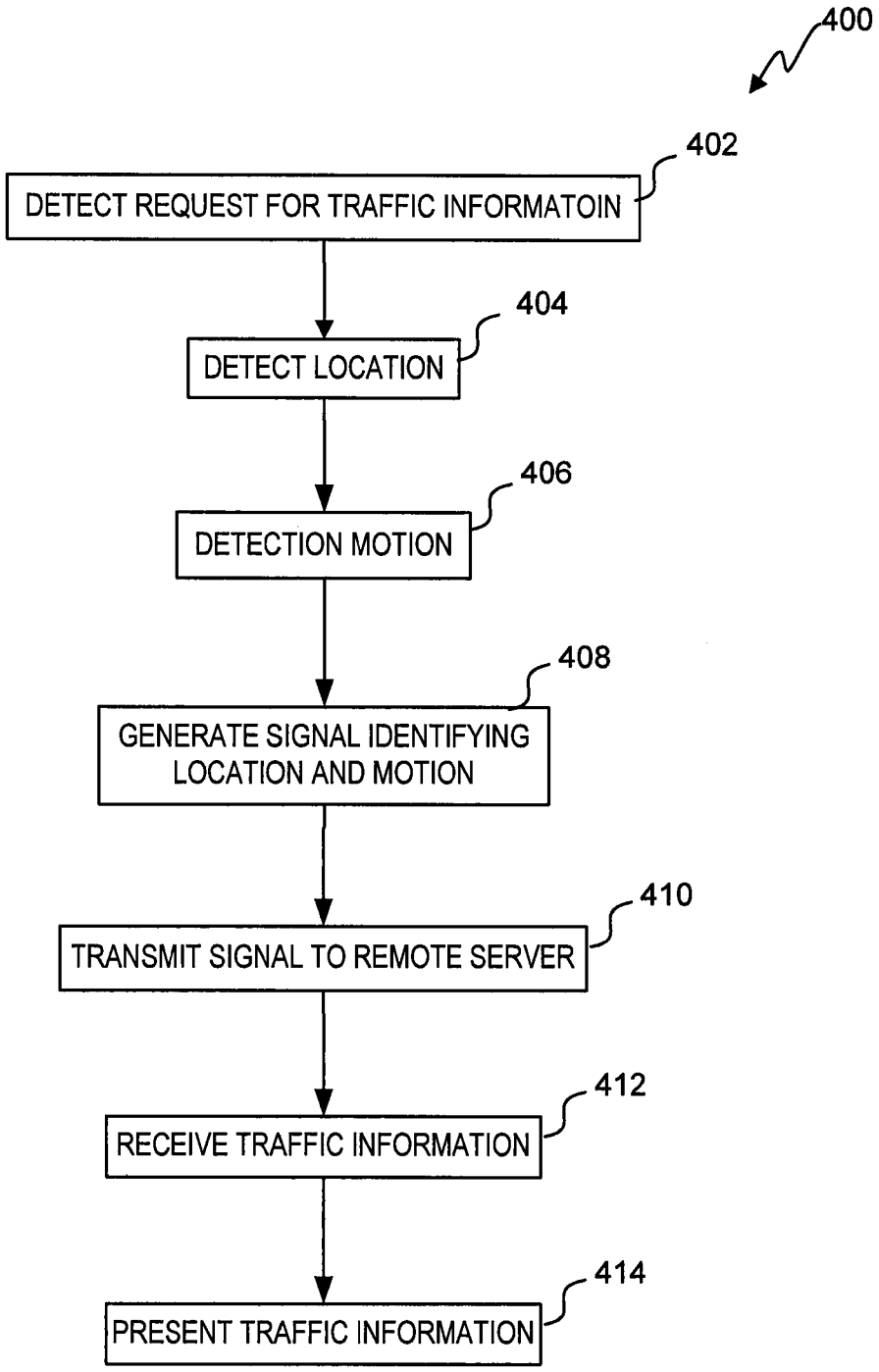
FIG. 4 is a flow diagram of a process for using a device to interact with a traffic-information service according to an embodiment of the present invention.

FIG. 4 is a flow diagram of a process 400 for using a device to interact with a traffic-information service according to an embodiment of the present invention. The traffic-information service can include a service that estimates (e.g., real-time) traffic information. The traffic-information service can be provided via remote traffic-information generator 150 based on data received from a set of devices executing traffic app 216. Process 500 can be implemented, e.g., in device 200 of FIG. 2 executing traffic app 216.

At block 402, device 200 detects a request for traffic information. The request can include a request from a user received via user input 206. For example, a user can launch traffic app 216, and traffic app 216 can include code that allows a user to select an option requesting: current traffic information, traffic information associated with a road, traffic information associated with a route, and/or information about nearby traffic congestion. The user can select the option by, e.g., pressing an area associated with the option on a touchscreen or pressing a selection-associated button (e.g., displayed on a touchscreen of device 200) or sequence of buttons. The user can ask for information (e.g., verbally). For example, the user could ask "How long will I be stuck in traffic?" In some instances, a user's launch of traffic app 216 itself is treated as a request for traffic information, e.g., information for a road (or roads) near the user's current location. In some instances, a user's input of a destination (e.g., destination address or name) is equated to a request for traffic information along a route to that destination.

A transmission condition 218 can indicate that a criterion for transmitting a signal to remote traffic-information generator 150 is detection of a request for traffic information. (For example, in some instances, the signal is not even generated until the criterion is satisfied, and in some instances, the signal is generated regardless but is not transmitted until the criterion is satisfied.) Thus, detection of the request can serve to indicate that a transmission condition has been satisfied.

At block 404, device 200 (e.g., via location/motion detector 212) can detect a location. The location can be a current location of device 200. The location can be determined by receiving GPS signals, cell-phone signals and/or signals from WiFi access points. A triangulation algorithm can then be applied to a set of signals to estimate a current location based on known locations of signal sources (e.g., satellites, cell-phone towers, or WiFi access points). The location can include geographic coordinates.

In some instances, the location of device 200 can serve as a proxy for a location of a vehicle 110*a*. For example, if device 200 is attached to or integrated with a vehicle 110*a*, it can be assumed that the location of device 200 is the same as a location of vehicle 110*a*. Even if device 200 is a mobile electronic device independent from vehicle 110*a*, the locations can still be equated at least in some instances. For example, if the current location is on a road (e.g., which can be determined subsequently by device 200 or remote traffic-information generator), it can be assumed that the location of device 200 is also a location of a vehicle 110*a* (e.g., assuming that a user has brought device 200 within vehicle 110*a*).

At block 406, device 200 (e.g., via location/motion detector 212) can detect a motion. The motion can be a current motion of device 200, which can be attributed to a current motion of a vehicle 100*a*. The motion can include, e.g., an instantaneous, time-averaged, time-varying, median, cumulative, absolute-value, or cumulative absolute-value variable. The variable can identify or relate to a velocity, speed and/or acceleration. The motion can be determined, e.g., by analyzing multiple time-lapsed locations. For example, in some instances, multiple locations are detected at block 404, and the difference between locations divided by the difference between times of the detection can serve as a velocity estimate. The motion can be determined by sensors in device 200 (e.g., within location/motion detector 212), such as an accelerometer. In some instances, device 200 can connect to a component of vehicle 110*a*, and the vehicle component can transmit a motion variable (e.g., speed) to device 200.

At block 408, device 200 can generate a signal that identifies the detected location and motion. In some instances, the signal further includes an indication of the request detected at block 402 or specific details regarding the request (e.g., that traffic information was requested along an identified, specific route or that a request was received for a location of a congestion source). The signal can include an identifier of device 200, such that remote traffic-information generator 150 can subsequently target device 200 for transmitting wireless signals. The signal can further include a destination location and/or route being traveled.

At block 410, device 200 can transmit the signal to remote traffic-information generator 150. Specifically, network interface 210 of device 200 can transmit the signal. The transmission can include a wireless transmission. Cellular data networks or other networks can be used.

At block 412, device 200 receives (e.g., via network interface 210) traffic information from remote traffic-information generator 150. The received traffic information can include or can be the traffic information requested by the user (detected at block 402). The traffic information can include, e.g., traffic information associated with locations near the detected location or along a road or route that the detected location is on. The traffic information can include traffic parameters, such as, an average speed, average velocity, location of a congestion source, and/or spatial or temporal distance to a congestion source from the detected location. Traffic information can be segregated based on spatial locations. For example, different roads or different portions along a road can be associated with different traffic-parameter values (e.g., average speeds). The received traffic information can include, e.g., a list or table of data or representations of an image (e.g., a pictorial representation of traffic information on a map).

At block 414, device 200 presents traffic information to the user (e.g., via user output 208). In some instances, the presented traffic information is similar to or the same as the received traffic information. In some instances, the presented traffic information can include a subset of and/or a processed version of the data in the received traffic information. For example, the received traffic information can be specific to a zip code, city or metropolitan area determined based on initial settings or the detected location. Device 200 can subsequently identify a subset of the traffic information that pertain to a more local area surrounding the detected location (or a subsequently detected location). As another example, device 200 can alter a format of the traffic information. The received traffic information can include, e.g., a table of data, and the presented traffic information can include a pictorial map (e.g., traffic map 160 or 160'). In some embodiments, the information can be presented audibly. For example, device 200 can receive text and convert the text to speech (e.g., "Head of congestion approximately 12 minutes away").

Figure 5:
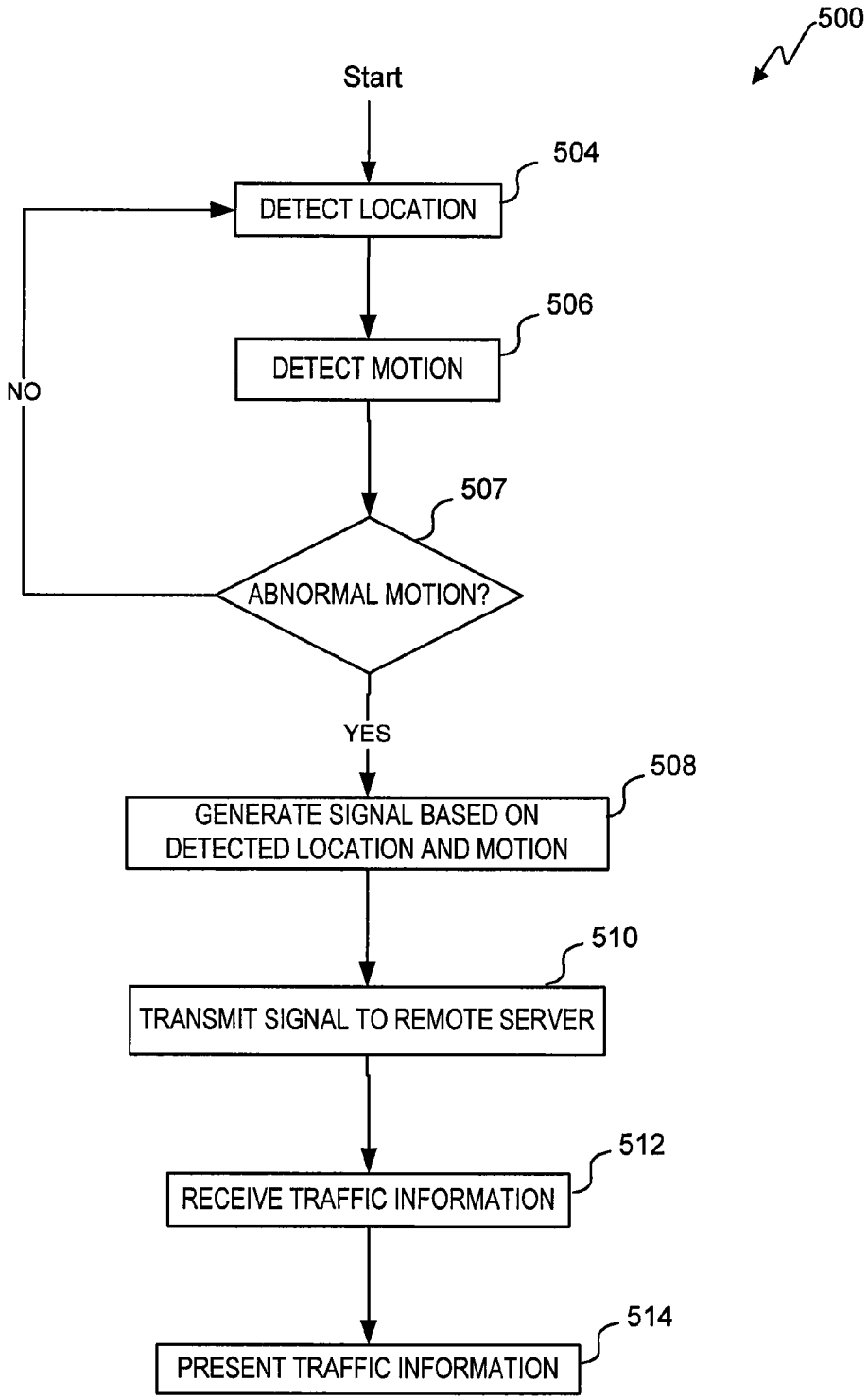
FIG. 5 is a flow diagram of a process for using a device to interact with a traffic-information service according to an embodiment of the present invention.

FIG. 5 is a flow diagram of another process 500 for using a device to interact with a traffic-information service according to an embodiment of the present invention. Process 500 can be implemented, e.g., in device 200 of FIG. 2 executing traffic app 216. Block 504-506 and 508 can be similar or identical to corresponding blocks of process 400 described above.

In the embodiment shown in FIG. 5, there is no block corresponding to block 402 in process 400. Rather, in this instance, initiation of the signal generation and transmission depends on a condition (e.g., defined by a transmission condition 218) that abnormal motion is detected at device 200 at block 507. Thus, motion of device 200 is repeatedly detected until the motion qualifies as abnormal at block 507. (In the depicted instance, the location is also repeatedly detected as detection of motion can rely on detection of a location in instances in which velocity is estimated based on differences of locations.)

Abnormal motion can include, e.g., a speed or velocity variable (e.g., median, average or instantaneous variable) that is below a threshold, an acceleration variable (e.g., cumulative or instantaneous variable) that is below or above a threshold (e.g., suggesting excessive braking) and/or variation of a motion variable that is above a threshold. The threshold can be determined based on empirical motion variables and/or speed limits. For example, training data can indicate that traffic is generally congested when a sum or average of absolute acceleration values over a time period exceed a specific threshold. The thresholds can be general or specific (e.g., to a spatial area or time period).

FIG. 5 shows an instance in which traffic information is received at block 512, and traffic information is presented a block 514. In some instances, these blocks are omitted from process 500. For example, traffic app 216 can generate and transmit the signal at blocks 508-510 but wait for a subsequent request from a user before requesting, receiving and/or presenting traffic information.

Figure 6:
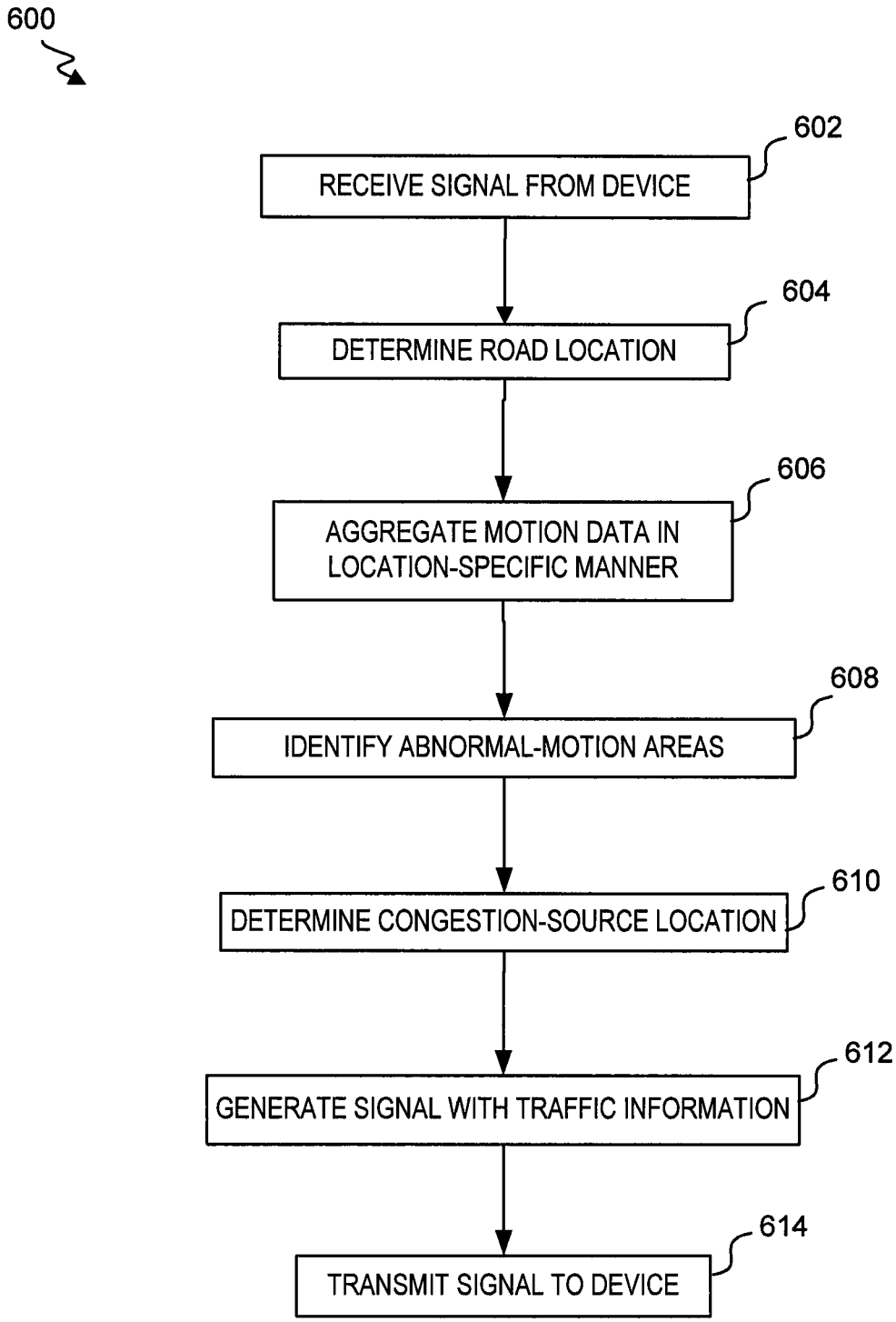
FIG. 6 is a flow diagram of a process for estimating traffic information according to an embodiment of the present invention.

FIG. 6 is a flow diagram of a process 600 for estimating traffic information according to an embodiment of the present invention. Process 600 can be implemented, e.g., in remote traffic-information generator 150 of FIG. 3 and operate to provide a traffic-information service.

At block 602, remote traffic-information generator 150 can receive (e.g., via network interface 310) a signal from device 200. For example, the signal can include a signal generated at block 408 of process 400 or at block 508 of process 500. The signal can include a location and motion of device 200. The signal can further include a request for traffic information.

At block 604, remote traffic-information generator 150 can determine a road location based on the signal. For example, the signal can include a geographic location (e.g., geographic coordinates). Remote traffic-information generator 150 can access a table or map (e.g., road map 314) that associates geographic locations with specific roads. In some instances, the determination further depends on a motion identified in the signal. For example, a specific location can be associated with two roads (e.g., when the roads intersect). However, by knowing a direction of movement (e.g., that is independently identified or apparent from a velocity), it can be determined which road device 200 is on. In addition to determining which road device 200 is on, remote traffic-information generator 150 can further determine which part of the road device 200 is on (e.g., associating geographic coordinates ($x_1$,$x_2$) with road y, mile z).

At block 606, remote traffic-information generator 150 can aggregate motion data in the signal with other motion data in a location-specific manner. For example, motion data in the signal received at block 602 can be aggregated with motion data previously received from other devices The aggregation can be performed in a timely manner, such that all data being aggregated corresponds to a same time period (e.g., within the last 10 minutes). The location-specificity of the aggregation can depend on the road-location determination at block 604. For example, if it is determined at block 604 that a device is on Road #1, then the motion data can be aggregated with other motion data associated with Road #1. In some instances, the aggregation includes collecting a set of motion "point sources". In some instances, the aggregation includes identifying a collective parameter, such as an average, median, or variance of a motion variable (e.g., an average speed). The aggregation can include data that are associated with a same road and within a similar area on the road.

In some instances, the aggregation of the data includes implementing assumptions about traffic based on a number or frequency of received signals. For example, each signal of a set of signals can be associated with a location. For a given time period, if few signals are associated with a particular road portion, it can be assumed that traffic is normal along the road portion. The assumption can be based, e.g., on a premise that users of devices 200 can be less likely to request traffic information when traffic is flowing adequately or based on knowledge about abnormal-motion triggers. Thus, road portions associated with relatively few signals can be characterized with qualitative traffic-parameter values such as, "Uncongested", "Good", or "Normal", or the portions can be characterized with quantitative traffic-parameter values, such as an average speed equal to a speed limit or based on an extrapolation of a speed-versus-request number curve.

At block 608, remote traffic-information generator 150 can identify abnormal-motion areas. The identification can be based on the aggregated motion data. Abnormal-motion areas can include areas associated with, e.g., low speeds or velocities or; high cumulative acceleration. In some instances, abnormal-motion areas can be identified based on data from third parties (e.g., based on Sig Alerts, aerial photography, or public traffic reports). In some instances, the third-party data can be integrated with device-originated data, e.g., such that device-originated data can provide confirmation, enhanced geographically specific detail, and/or enhanced temporal detail regarding the extent (e.g., magnitude, temporal extent and geographic extent) of the abnormal motion.

In some instances, the abnormal-motion areas can be determined based on a comparison of the aggregated motion data to default traffic information 316. Default traffic information 316 can include a general set of traffic information or traffic information specific to a time period. Default traffic information 316 can identify, e.g., an average traffic speed along a road associated with a time period, a speed limit along a road portion, or a distribution of acceleration values. If the aggregated motion data is different than default traffic information 316 for a specific area, the area can be characterized as abnormal. In some instances, the identification of an abnormal-motion area can suggest or indicate that the area is subjected to traffic congestion.

At block 610, remote traffic-information generator 150 can determine a congestion-source location. The congestion source can include a location associated with an end-point or inversion point of values of a motion variable. For example, average speeds can be determined for portions of a particular road. The average speeds can gradually decrease up until a particular location, after which the average speeds increase. The location can be identified as the congestion-source location.

At block 612, a signal is generated, by remote traffic-information generator 150, the signal including traffic information (e.g., traffic-parameter values). The traffic information can include the aggregated motion data from block 606, identification of the abnormal-motion areas (identified at block 608), and/or identification of the congestion-source location (identified at block 610). The traffic information can include a table (e.g., associating specific road portions with specific traffic information), numeric values, and/or textual values In some instances, a traffic map 318 is generated, which can associate specific road portions with specific traffic information (e.g., in a pictorial representation). The signal can include data that represent traffic map 318.

The traffic information can be general or specific to device 200. For example, traffic information can be identified around the location of the device and/or along a road identified at block 604. Traffic information can further indicate an estimated time or distance separating device 200 from a congestion source or destination. In some instances, the signal further includes an alternative-route suggestion to reduce commute time.

At block 614, the signal can be transmitted from remote traffic-information generator 150 to device 200. Specifically, network interface 410 of remote traffic-information generator 150 can transmit the signal. The transmission can include a wireless transmission.

As noted above, process 600 can include an ongoing process, such that traffic information is repeatedly modified based on new data. For example, new data can be aggregated with recent data, and old data can be removed from the aggregation. Thus, in this instance, process 600 can be performed for each received signal. As another example, blocks 602 and 604 can be repeated throughout a time period or until a threshold amount of signals are received, after which blocks 606-610 can be performed. Meanwhile, a signal can still be immediately generated and transmitted (at blocks 612-614) based on the most recently estimated traffic information.

Portions of the description can refer to particular functions or acts performed by device 200 or by remote traffic-information generator 150. In some instances, a function noted to be performed by device 200 can be performed by remote traffic-information generator 150. For example, device 200 can receive GPS signals and transmit GPS data to remote traffic-information generator 150, which then detects a location of device 200 based on the GPS signal. Conversely, in some instances, a function noted to be performed by remote traffic-information generator 150 can be performed by device 200. For example, device 200 can determine its road location (e.g., by consulting a traffic map 318 and/or associating geographic coordinates with the road location), and the road location can then be transmitted in a signal to remote traffic-information generator 150.

In some instances, a user makes a request but there is little or no (e.g., available or recent) data that can be used to respond to the request. Such instances may arise, e.g., when there is a small data quantity associated with a road, route, road portion and/or a recent time period (e.g., within the last hour). While in some instances, the small data quantity may indicate that the road, route or road portion is uncongested, this assumption may be less certain in some circumstances (e.g., if a requesting device is traveling at slow speeds or if the available data indicates traffic congestion). If a traffic estimation is associated with a low confidence metric or is associated with inconsistent data, a user may be alerted of this occurrence. For example, a response may include: "Insufficient data", a confidence level, a number of data points contributing to a traffic-condition estimation, or a number of nearby devices 200 that recently transmitted information to remote traffic-information generator 150. A user may also or alternatively be provided with information still potentially relevant to the user. For example, a distance to a source could be presented along with a confidence metric. As another example, a traffic condition along a nearby street or along a local network of streets could be presented.

Embodiments described herein can provide cooperative traffic information to a number of users while respecting user privacy. In some instances, a device sends data about its location and motion to a server when the user requests information. The request can be taken as implied consent to share the data, or the device can ask the user to confirm that the data can be shared. It is contemplated that users may be more likely to request (and therefore provide) location and motion data when they are experiencing traffic congestion than when they are not. To the extent this occurs in practice, a traffic-information service can obtain and provide information about congestion areas without managing large amounts of data pertaining to uncongested areas; data traffic at the server can thus be reduced.

Portions of the description can refer to particular user interfaces, such as touchscreen displays. Other embodiments can use different interfaces. For example, a user interface can be voice-based, with the user speaking instructions into a microphone or other audio input device and the device providing an audible response (e.g., using synthesized speech or pre-recorded audio clips). A combination of voice-based and visual interface elements can be used, and in some embodiments, multiple different types of interfaces can be supported, with the user having the option to select a desired interface, to use multiple interfaces in combination (e.g., reading information from the screen and speaking instructions) and/or to switch between different interfaces. Any desired form of user interaction with a device can be supported.

Embodiments of the present invention can be realized using any combination of dedicated components and/or programmable processors and/or other programmable devices. The various processes described herein can be implemented on the same processor or different processors in any combination. Accordingly, where components are described as being configured to perform certain operations, such configuration can be accomplished, e.g., by designing electronic circuits to perform the operation, by programming programmable electronic circuits (such as microprocessors) to perform the operation, or any combination thereof. Processes can communicate using a variety of techniques including but not limited to conventional techniques for interprocess communication, and different pairs of processes can use different techniques, or the same pair of processes can use different techniques at different times. Further, while the embodiments described above can make reference to specific hardware and software components, those skilled in the art will appreciate that different combinations of hardware and/or software components can also be used and that particular operations described as being implemented in hardware might also be implemented in software or vice versa.

Computer programs incorporating various features of the present invention can be encoded and stored on various computer readable storage media; suitable media include magnetic disk or tape, optical storage media such as compact disk (CD) or DVD (digital versatile disk), flash memory, and other non-transitory media. Computer readable media encoded with the program code can be packaged with a compatible electronic device, or the program code can be provided separately from electronic devices (e.g., via Internet download or as a separately packaged computer-readable storage medium).

Thus, although the invention has been described with respect to specific embodiments, it will be appreciated that the invention is intended to cover all modifications and equivalents within the scope of the following claims.

What is claimed is:

1. A method of determining traffic information, the method comprising:

receiving, at a server, a request from each mobile electronic device of a set of mobile electronic devices, the request being for traffic information that relates to an estimate of a traffic speed of interest to a user of the mobile electronic device;

receiving, at the server, data from each mobile electronic device of the set of mobile electronic devices, wherein the received data indicates a velocity and location of the mobile electronic device;

aggregating, by the server, the data from the set of mobile electronic devices in a location-specific manner, wherein the aggregated data includes data indicative of velocities of only mobile electronic devices associated with requests for traffic information occurring within a time period;

determining, by the server, the traffic information based on the aggregated data; and communicating, by the server, the traffic information to a first one of the mobile electronic devices.

2. The method of claim 1 wherein the set of mobile electronic devices includes the first one of the mobile electronic devices.

3. The method of claim 1 wherein the request for traffic information represents an implicit or explicit permission to collect the data from the mobile electronic device from which the request is received.

4. The method of claim 1 further comprising:

determining, for each mobile electronic device of the set of mobile electronic devices, a road coinciding with an absolute location of that one of the mobile electronic devices, the location of the mobile electronic device including the absolute location, wherein the data is aggregated in a road-specific manner.

5. The method of claim 1 wherein determining the traffic information includes implementing an assumption that traffic is normal along a road portion associated with relatively few traffic-information requests.

6. The method of claim 1 further comprising:

determining, by the server, a location of a congestion source based on the aggregated data, wherein the traffic information includes the location of the congestion source.

7. The method of claim 1 further comprising:

determining, at the server and for each mobile electronic device of the set of mobile electronic devices, that a data-transmission condition has been satisfied based on the receipt of the request; and requesting, by the server and in response to the determination that the data-transmission condition has been satisfied, the data from each mobile electronic device of the set of mobile electronic devices.

8. A system, comprising:

one or more data processors; and a non-transitory computer readable storage medium containing instructions which when executed on the one or more data processors, cause the one or more data processors to perform actions including:

receiving a request from each mobile electronic device of a set of mobile electronic devices, the request being for traffic information that relates to an estimate of a traffic speed of interest to a user of the mobile electronic device;

receiving data from each mobile electronic device of the set of mobile electronic devices, wherein the received data indicates a velocity and location of the mobile electronic device;

aggregating the data from the set of mobile electronic devices in a location-specific manner, wherein the aggregated data includes data indicative of velocities of only mobile electronic devices associated with requests for traffic information occurring within a time period;

determining the traffic information based on the aggregated data; and communicating the traffic information to a first one of the mobile electronic devices.

9. The system of claim 8 wherein the set of mobile electronic devices includes the first one of the mobile electronic devices.

10. The system of claim 8 wherein the request for traffic information represents an implicit or explicit permission to collect the data from the mobile electronic device from which the request is received.

11. The system of claim 8, wherein the actions further include:

determining, for each mobile electronic device of the set of mobile electronic devices, a road coinciding with an absolute location of that one of the mobile electronic devices, the location of the mobile electronic device including the absolute location, wherein the data is aggregated in a road-specific manner.

12. The system of claim 8 wherein determining the traffic information includes implementing an assumption that traffic is normal along a road portion associated with relatively few traffic-information requests.

13. The system of claim 8, wherein the actions further include:

determining a location of a congestion source based on the aggregated data, wherein the traffic information includes the location of the congestion source.

14. The system of claim 8, wherein the actions further include:

determining, for each mobile electronic device of the set of mobile electronic devices, that a data-transmission condition has been satisfied based on the receipt of the request; and requesting, in response to the determination that the data-transmission condition has been satisfied, the data from each mobile electronic device of the set of mobile electronic devices.

15. A computer-program product tangibly embodied in a non-transitory machine-readable storage medium, including instructions configured to cause one or more data processors to perform actions including:

receiving a request from each mobile electronic device of a set of mobile electronic devices, the request being for traffic information that relates to an estimate of a traffic speed of interest to a user of the mobile electronic device;

receiving data from each mobile electronic device of the set of mobile electronic devices, wherein the received data indicates a velocity and location of the mobile electronic device;

aggregating the data from the set of mobile electronic devices in a location-specific manner, wherein the aggregated data includes data indicative of velocities of only mobile electronic devices associated with requests for traffic information occurring within a time period;

determining the traffic information based on the aggregated data; and communicating the traffic information to a first one of the mobile electronic devices.

16. The computer-program product of claim 15 wherein the set of mobile electronic devices includes the first one of the mobile electronic devices.

17. The computer-program product of claim 15 wherein the request for traffic information represents an implicit or explicit permission to collect the data from the mobile electronic device from which the request is received.

18. The computer-program product of claim 15, wherein the actions further include:

determining, for each mobile electronic device of the set of mobile electronic devices, a road coinciding with an absolute location of that one of the mobile electronic devices, the location of the mobile electronic device including the absolute location, wherein the data is aggregated in a road-specific manner.

19. The computer-program product of claim 15 wherein determining the traffic information includes implementing an assumption that traffic is normal along a road portion associated with relatively few traffic-information requests.

20. The computer-program product of claim 15, wherein the actions further include:

determining a location of a congestion source based on the aggregated data, wherein the traffic information includes the location of the congestion source.

21. The computer-program product of claim 15, wherein the actions further include:

determining, for each mobile electronic device of the set of mobile electronic devices, that a data-transmission condition has been satisfied based on the receipt of the request; and requesting, in response to the determination that the data-transmission condition has been satisfied, the data from each mobile electronic device of the set of mobile electronic devices.

* * * * *